US005816269A

United States Patent [19]

Mohammed

[11] Patent Number: 5,816,269

[45] Date of Patent: Oct. 6, 1998

[54] TATOO STENCIL MECHANISM

[76] Inventor: Khadija Mohammed, 9022 Beverlywood St., Los Angeles, Calif. 90034

[21] Appl. No.: 977,476

[22] Filed: Nov. 24, 1997

[51] Int. Cl.[6] ..... A45D 40/30

[52] U.S. Cl. ..... 132/319; 132/285

[58] Field of Search ..... 132/319, 73.5, 132/75.3, 285; 101/129, 35, 126, 127, 128.4, 128.21; 2/239

[56] References Cited

U.S. PATENT DOCUMENTS

| | | | |
|---|---|---|---|
| 2,969,014 | 1/1961 | Hanson et al. | 101/128.21 |
| 2,969,731 | 1/1961 | Kendall | 101/128.21 |
| 3,789,756 | 2/1974 | Weber | 101/128.21 |
| 3,929,068 | 12/1975 | Budden | 101/128.21 |
| 4,974,610 | 12/1990 | Orsini | 132/285 |
| 5,525,389 | 6/1996 | Hoffmann et al. | 132/285 |

FOREIGN PATENT DOCUMENTS

| | | | |
|---|---|---|---|
| 2673363 | 9/1992 | France | 132/319 |

*Primary Examiner*—Gene Mancene
*Assistant Examiner*—Pedro Philogene
*Attorney, Agent, or Firm*—Erik M. Arnhem

[57] ABSTRACT

A temporary tattoo can be formed on a person's skin, using a stencil mechanism that has flexibility and adhesive attachment to the skin surface. For handling and storage purposes, the flexible stencil sheet is sandwiched between a backing sheet and a protective carrier sheet. In use of the stencil mechanism, the protective carrier sheet and stencil sheet are torn away from the backing sheet to expose an adhesive film on the stencil sheet. After the stencil sheet has been adhesively attached to the skin surface the carrier sheet is peeled off of the stencil sheet to expose the stencil openings. Colored dye is applied through the stencil openings to form a temporary tattoo on the skin surface.

9 Claims, 1 Drawing Sheet

TATOO STENCIL MECHANISM

BACKGROUND OF THE INVENTION

This invention relates to a stencil mechanism, and particularly to a stencil mechanism that can be used to form a temporary tattoo on a person's skin. The stencil mechanism provides an alternative for those persons who do not wish to have a permanent tattoo or to undergo the pain associated with tatoo needles.

Conventional stencil sheets are not considered practical for forming tattoos on a person's skin because such stencil sheets are not easily attached to a person's skin. Such conventional stencil sheets lack the desired flexibility to conform to a person's skin contours. Additionally such conventional stencil sheets are not adherent on a person's skin.

If a conventional stencil sheet were to be used to form a temporary tattoo on a person's skin the stencil sheet could not be maintained in close contact with the person's skin around the entire peripheral edge of the stencil opening, due to the fact that the stencil sheet does not have the flexibility to conform to the skin surface. A colored dye applied to the skin surface through the stencil opening would tend to spread out beneath the stencil sheet so as to have an irregular non-distant configuration on the skin surface.

SUMMARY OF THE INVENTION

The present invention relates to a stencil assembly especially useful for forming a tattoo on a person's skin. The stencil sheet is formed out of a relatively thin flexible sheet material having the capability of closely conforming to skin surface curvatures, depressions and protrusions. Also, the surface of the stencil sheet facing the skin surface has a contact adhesive film thereon, whereby the flexible stencil sheet can adhere to the skin surface around the entire peripheral edge of each stencil opening, such that colored dye applied through the stencil opening has a distinct sharp edge demarcation on the skin surface.

In order to protect the adhesive flexible stencil sheet from inadvertent folding or attachment to external objects while the stencil sheet is being stored or handled, the stencil sheet is laminated between a backing sheet and a protective carrier sheet.

A first adhesive film on the stencil sheet laminates the stencil sheet to the backing sheet. A second adhesive film on the carrier sheet laminates the carrier sheet to the stencil sheet. The three layer laminate can be stored and handled without any danger of the stencil sheet folding or attaching itself to external objects. The adhesive films are located within the laminate, not on the laminate exterior surface.

When it is desired to use the stencil sheet for forming a temporary tattoo on a person's skin, the stencil sheet and protective carrier sheet are peeled away as a unit from the backing sheet so as to expose the first adhesive film on the stencil sheet. The two layer laminate, comprised of the carrier sheet and stencil sheet, is then pressed firmly against the person's skin so that the stencil sheet is releasably adhered to the skin surface, via the first adhesive film.

The carrier sheet is peeled away from the stencil sheet, while retaining the stencil sheet on the skin surface. Separation of the carrier sheet from the stencil sheet exposes the stencil opening in the stencil sheet, such that colored dye can be applied to the skin surface through the stencil opening. Application of the colored dye to the skin surface can be carried out by brushing, spraying, or spreading the dye material on the exposed skin surface. The colored dye can be in pasteform or liquid form. A paste-like consistency is preferred in order to deter migration of the dye beyond the stencil opening underneath the stencil sheet material.

Further features of the invention will be apparent from the attached drawings and description of a stencil mechanism embodying the invention.

DESCRIPTION OF A PREFERRED EMBODIMENT OF THE INVENTION

Figure 1:
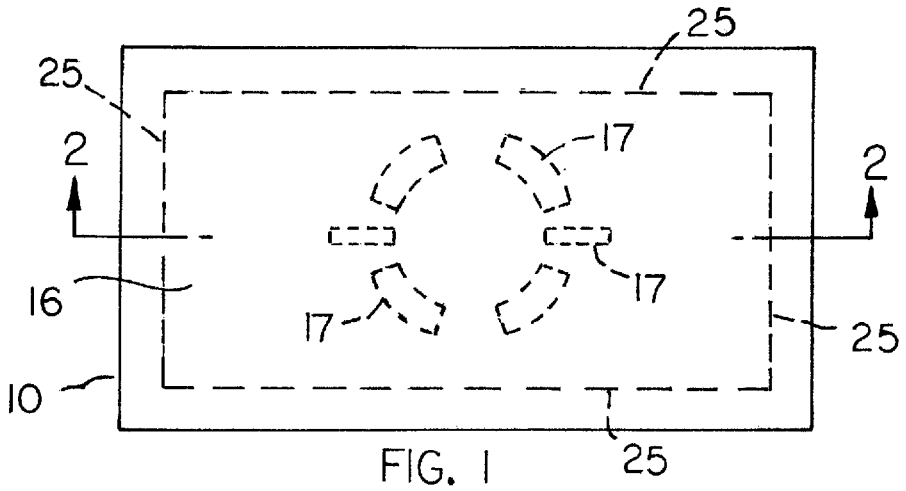
FIG. 1 is a plan view of a stencil mechanism embodying the invention.
Figure 2:
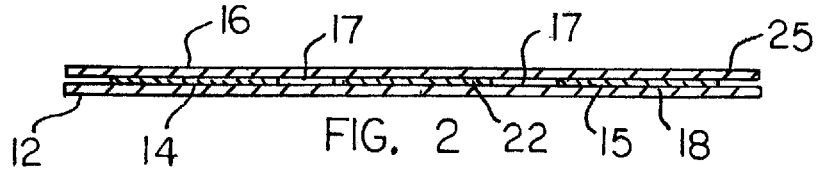
FIG. 2 is a transverse sectional view taken on line 2—2 in FIG. 1.

FIG. 1 is a plan view of a stencil mechanism 10 constructed according to the invention. As shown in FIG. 2, the mechanism comprises a three sheet lamination that includes a relatively stiff backing sheet 12, flexible stencil sheet 14, and flexible protective carrier sheet 16.

Backing sheet 12 may be a relatively thick paper sheet having non-porous glossy surfaces, similar to coated paper sheet materials used on glossy magazine covers. The glossy coating on such papers gives the paper a non-porous smooth surface that allows the paper sheet to be readily released from adhesive attachment to the flexible stencil sheet 14. Backing sheet 12 has a preferred thickness of about 0.006 inch. The coating on the sheet somewhat stiffens the sheet against undesired creasing or folding while the lamination is being stored or handled.

Stencil sheet 14 is preferably formed of a vinyl plastic sheet material having a preferred thickness of about 0.003 inch or 0.004 inch. The plastic sheet is very flexible, so as to be capable of closely conforming to contour changes on a person's skin. The lower surface 15 of sheet 14 has a first contact adhesive film 18 thereon, whereby sheet 14 is adhesively attachable to backing sheet 12. The upper surface of sheet 14 is relatively smooth and non-porous, whereby sheet 14 can be released from adhesive attachment to carrier sheet 16.

Figure 5:
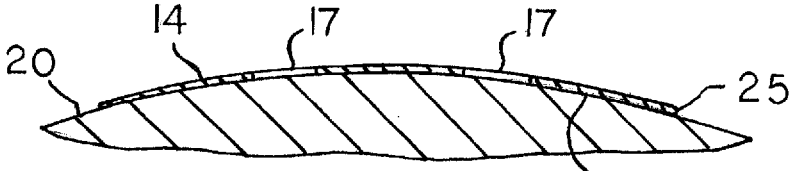
FIG. 5 is a sectional view taken in the same direction as FIG. 4, but after removal of a carrier sheet from the stencil sheet. The stencil opening in the stencil sheet is exposed so that colored dye can be applied through the stencil opening onto the person's skin.

Stencil sheet 14 has one or more stencil openings 17 therein adapted to pass colored dye onto a person's skin. As shown in FIG. 5, stencil sheet 14 is adhesively attached to a human skin surface 20, such that a colored dye can be applied through the stencil openings 17 onto the skin surface. Adhesive film 18 on the stencil sheet surface 15 firmly attaches the sheet to the human skin surface so as to form a seal around the peripheral edge of the stencil opening. The colored dye is thus prevented from spreading beyond the stencil opening underneath the stencil sheet material. Adhesive film 18 can be a contact gum adhesive having a capability for mechanically locking sheet 14 to the skin surface.

Figure 3:
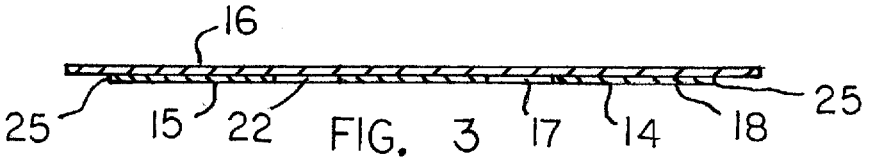
FIG. 3 is a view taken in the same direction as FIG. 2, but showing the stencil mechanism after removal of a backing sheet.
Figure 4:
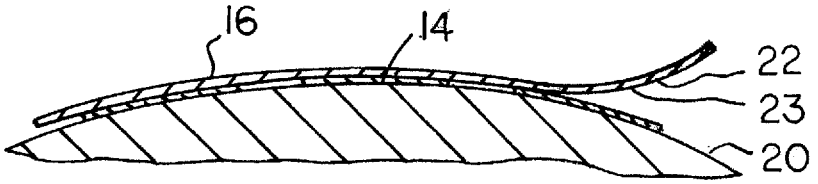
FIG. 4 is a sectional view showing the FIG. 2 mechanism after placement on a person's skin, e.g. prior to the application of colored dye through the stencil opening.

Referring to FIGS. 2 through 4, protective carrier sheet 16 can be formed of a light-transmitting material, whereby the stencil openings 17 are visible through sheet 16 when sheet 16 is laminated to stencil sheet 14, as in FIGS. 1 through 4. Carrier sheet 16 can be a semi-transparent gauze paper sheet having a second adhesive film 22 on its lower surface 23, i.e. the surface in contact with stencil sheet.

The second adhesive film 22 has a lesser adhesive holding force than the adhesive holding force of adhesive film 18 whereby the protective carrier sheet 16 can be peeled away from stencil sheet 14 without detaching the stencil sheet from the human skin surface. FIG. 4 shows a transitional stage during the process of tearing the protective carrier sheet 16 from stencil sheet 14, while sheet 14 remains in place on skin surface 20.

Protective carrier sheet 16 can have a thickness of about 0.004 inch or 0.005 inch. The thickness and material for sheet 16 are selected so that sheet 16 is light-transmitting (semi-transparent) and flexible. Sheet 16 has a greater flexibility than backing sheet 12, such that sheet 16 and stencil sheet 14 can be peeled away from backing sheet 16 as a unit. The three layer lamination, comprised of sheets 12, 14 and 16, has a desired overall stiffness and tear resistance while the lamination is being stored or handled.

The overall thickness of the lamination is preferably about 0.015 inch. The vinyl plastic stencil sheet 14 has a preferred black coloration for visual contrast with the white coloration of the protective carrier sheet 16, such that the stencil openings 17 are more clearly visible through the protective carrier sheet 16. Such visibility is necessary in order that the user can select the stencil mechanism, based on the particular stencil opening 17 configuration that he or she wishes to use. Preferably the tattoo marketing entity will maintain a suitable variety of stencil opening configurations designed to appeal to a wide range of personal choices. The stencil opening 17 shown in FIG. 1 is merely representative of different stencil opening configurations that might be offered.

Backing sheet 12 and carrier sheet 16 are rectangular sheets having the same face area. Typically, each sheet 12 or 16 is a rectangular sheet having a length of about four inch and a width of about two and one half inch. Stencil sheet 14 is a rectangular sheet having a somewhat smaller face area than sheets 12 and 16, whereby edges 25 of sheet 14 are spaced inwardly from the outer edges of sheets 12 and 16; i.e. the edges of sheets 12 and 16 protrude beyond edges 25 of sheet 14. The protrusions of the sheet 12,16 edges provide surfaces that the person can grip with his or her thumbs and fingers to facilitate the process of peeling sheets 16 and 14 away from the backing sheet 12.

FIG. 2 shows the three layer lamination in the initial condition for storage or handling. The adhesive films 18 and 22 hold the layers in the laminated condition, wherein the relatively fragile and flexible stencil sheet is protected against creasing, folding or undesired adhesive attachment to external objects or surfaces.

FIG. 3 shows stencil sheet 14 and protective carrier sheet 16 after separation from backing sheet 12. To proceed from the FIG. 2 condition to the FIG. 3 condition the person grips selected edges of sheets 12 and 16 between the thumbs and fingers, after which the gripped edges are pulled apart until sheet 12 is completely separated from sheets 14 and 16.

The stencil sheet 14 will stay with carrier sheet 16, rather than remaining attached to backing sheet 12. The adhesion force between carrier sheet 16 and stencil sheet 14 is greater than the adhesion force between sheet 14 and backing sheet 12, because of the glossy nature of the backing sheet surface. Even though adhesive film 18 on sheet 14 is relatively strong the smooth non-porous glossy surface or backing sheet 12 is sufficiently slippery as to release backing sheet from stencil sheet 14 when the edges of sheets 12 and 16 are pulled apart. Adhesive film 22 holds stencil sheet 14 in place on protective carrier sheet 12.

The two layer lamination, comprising stencil sheet 14 and carrier sheet 16, is placed on the human skin surface 20 (at any desired accessible location), after which pressure is applied to the exposed surface of carrier sheet 16 to produce a relatively strong adhesive bond between adhesive film 18 and skin surface 20.

Then, as shown in FIG. 4, the protective carrier sheet 16 is pulled away from the skin surface to peel carrier sheet 16 from stencil sheet 14 without disturbing or detaching sheet 14 from skin surface 20.

Adhesive film 18 is preselected to have a greater holding (adhesion) force than adhesive film 22, such that a protruding edge of carrier sheet 16 can be gripped, and drawn across and away from stencil sheet 14 without disturbing sheet 14. The process of separating carrier sheet 16 from stencil sheet 14 can be facilitated by applying manual pressure on an edge of sheet 14 while sheet 16 is being pulled away from sheet 16; any thin-edged article can be passed back and forth across the exposed surface of sheet 16 to ensure intimate contact between adhesive film 18 and the skin surface. Such manual pressure by the thin-edged article increases the bond of adhesive 18 to the skin surface so as to better prevent sheet 14 from leaving the skin surface when sheet 16 is pulled away from the skin, as depicted in FIG. 4.

The term protective carrier sheet is applied to sheet 16 because sheet 16 carries the relatively fragile foldable stencil sheet 14 when sheet 14 is being placed against skin surface 20. If it were attempted to place sheet 14 against skin surface 20 without the support action of carrier sheet 16, the stencil sheet would fold and crease at several undetermined points, such that the adhesive film 18 would attach sheet 14 as an irregular bumpy layer on the skin substrate; the stencil openings 17 would be distorted. Sheet 16 carries stencil sheet 14 as a smooth unwrinkled thin lamination while sheet 14 is being adhesively attached to skin surface 20. Select 16 acts as a protective carrier for stencil sheet 14.

Stencil sheet 14 is a relatively thin flexible plastic sheet having a thickness of only about 0.003 inch or 0.004 inch. The relatively thin flexible sheet can bend or flex so as to follow and conform to skin surface 20 curvatures and contours, without leaving gaps between sheet 14 and skin surface 20.

FIG. 5 shows stencil sheet 14 adhesively attached to skin surface 20, with the stencil openings 17 exposed for transmission of colored dye onto the skin surface. The colored dye can be in paste form, or viscous liquid form. The dye can be applied to skin surface 20 in various ways, e.g. by brushing or spraying or spreading from an extrusion nozzle.

When the colored dye is in paste form, it can be contained in a squeezable tube equipped with a nozzle. By holding the nozzle against the exposed skin surface and squeezing the tube the colored paste can be distributed onto the skin surface. As noted above, the colored dye can be applied to the stencil openings in various ways, e.g. brushing or spraying or spreading. Stencil sheet 14 is left on the skin surface until the colored dye is fully dried. When the stencil sheet is pulled off the skin surface a colored image having the shape of the stencil openings 17 is left on the skin surface. Such an image forms a temporary tattoo. Depending on the nature of the colored dye, the tattoo will last for a temporary period, e.g. one or two weeks, until it is washed off with soap and water, or other cleaning material.

The use of the stenciling mechanism is advantageous in that the tattoo is formed on the skin surface without afflicting pain; no skin-puncturing needles are used. Also, the tattoo is temporary; if the person desires to later remove the tattoo for any reason the tattoo can be removed with soap and water, or other cleaning solution.

What is claimed:

1. A mechanism for stenciling a temporary tattoo on a person's skin comprising:

a flexible stencil sheet having at least one opening therein configured in the shape of a tattoo that is to be formed on a person's skin; said flexible stencil sheet having a first surface adapted to be placed against a person's kin, and a second surface adapted to face away from a person's skin;

a first contact adhesive film on said first surface of said flexible stencil sheet;

a relatively stiff backing sheet having a glossy surface releasably engaged with said contact adhesive film on said flexible stencil sheet;

a flexible protective carrier sheet having a second contact adhesive film thereon releasably engaged with said second surface on said flexible stencil sheet, whereby said carrier sheet is releasably attached to said stencil sheet;

the releasable adhesion force between said carrier sheet and said stencil sheet being greater than the releasable adhesion force between said stencil sheet and said backing sheet, whereby said stencil sheet can be peeled away from said backing sheet without separating said stencil sheet from said carrier sheet.

2. The stenciling mechanism of claim 1, wherein each said sheet has a thickness dimension; the thickness dimension of said backing sheet being greater than the thickness dimension of said stencil sheet.

3. The stenciling mechanism of claim 2, wherein said backing sheet has a thickness dimension of about 0.006 inch, and said stencil sheet has a thickness dimension of about 0.003 inch.

4. The stenciling mechanism of claim 3, wherein said stencil sheet is formed of a vinyl plastic material.

5. The stenciling mechanism of claim 2, wherein said protective carrier sheet is formed of a light-transmitting sheet material.

6. The stenciling mechanism of claim 5, wherein said protective carrier sheet has a thickness dimension of about 0.004 inch.

7. The stenciling mechanism of claim 5, wherein said protective carrier sheet is formed of a gauze material.

8. The stenciling mechanism of claim 1, wherein said backing sheet and said protective carrier sheet have a larger face area than said stencil sheet, whereby a border portion of the carrier sheet protrudes beyond said stencil sheet to provide a gripper for peeling the backing sheet and stencil sheet away from said backing sheet.

9. The stenciling mechanism of claim 1, wherein said stencil sheet is formed of vinyl plastic having a thickness of about 0.003 inch.

* * * * *